US009869088B1

(12) United States Patent
Hermes

(10) Patent No.: US 9,869,088 B1
(45) Date of Patent: Jan. 16, 2018

(54) COVER FOR C-SHAPED STUD

(71) Applicant: Nathan John Hermes, Gainesville, TX (US)

(72) Inventor: Nathan John Hermes, Gainesville, TX (US)

( * ) Notice: Subject to any disclaimer, the term of this patent is extended or adjusted under 35 U.S.C. 154(b) by 0 days.

(21) Appl. No.: 15/268,133

(22) Filed: Sep. 16, 2016

(51) Int. Cl.
*E04C 2/08* (2006.01)

(52) U.S. Cl.
CPC ..... *E04C 2/08* (2013.01)

(58) Field of Classification Search
CPC ..... E04B 9/005; E04C 2/08
USPC ..... 52/DIG. 8
See application file for complete search history.

(56) References Cited

U.S. PATENT DOCUMENTS 4,602,469 A * 7/1986 Nuckel, Jr. ..... E04D 3/30 52/520
4,718,213 A * 1/1988 Butterfield ..... E04B 9/005 52/311.2
5,201,597 A * 4/1993 Wurl ..... B21D 39/03 29/522.1
5,514,432 A * 5/1996 Lisec ..... E06B 3/66314 248/208
5,881,508 A * 3/1999 Irvine ..... E01C 5/20 405/219
6,305,137 B1 * 10/2001 Rebman ..... E04B 9/068 52/311.3
6,553,732 B2 4/2003 Shaw
8,365,490 B2 2/2013 Kinzler
2010/0107549 A1 5/2010 Ingram

* cited by examiner

*Primary Examiner* — Gisele Ford
(74) *Attorney, Agent, or Firm* — Plager Schack LLP

(57) ABSTRACT

A cover for a C-shaped stud comprising a semi-rigid plate having a first face with a first end and a second end, the distance between the first and second end sufficient to cover the space between the L-shaped legs of the C-shaped stud. A pair of U-shaped clips each positioned proximal to opposite ends of the plate and configured to engage each L-shaped flange of the stud enabling the cover to be applied to the C-shaped stud by bending the plate sufficiently to permit the leg of each L-shaped flange to fit within the U-shaped clip. A further embodiment incorporating a spring means configured to be biased so as to be positioned within the C-shaped stud to engage one of the L-shaped flanges to provide a biasing force on the cover to secure the cover to the C-shaped stud.

4 Claims, 2 Drawing Sheets

COVER FOR C-SHAPED STUD

BACKGROUND

The embodiments herein relate generally to a cover for a C-shaped stud having a first L-shaped flange with first and second legs and a second L-shaped flange with first and second legs.

SUMMARY

A cover for a C-shaped stud having a first L-shaped flange with first and second legs and a second L-shaped flange with first and second legs, and web between the first and second L-shaped flanges. The space between the second leg of the first L-shaped flange and the second leg of the second L-shaped flange has a first dimension. The cover comprises a semi-rigid plate having a first face comprising a first end and a second end, the distance between the first and second end comprising a second dimension greater than the first dimension. A first U-shaped clip having generally parallel legs, the first U-shaped clip positioned proximal the first end of the plate and configured to engage the second leg of the first L-shaped flange of the stud such that the second leg of the first L-shaped flange is secured between the generally parallel legs of the first U-shaped clip; and a second U-shaped clip having generally parallel legs, the second U-shaped clip positioned proximal the second end of the plate and configured to engage the second leg of the second L-shaped flange of the stud such that the second leg of the second L-shaped flange is secured between the generally parallel legs of the second U-shaped clip whereby the cover can be applied to the C-shaped stud by bending the plate sufficiently to permit the second legs of each of the first and second L-shaped flanges to fit within the generally parallel legs of the first and second U-shaped clips.

The cover for a C-shaped stud further incorporates a spring means positioned between the first and second U-shaped clips on the plate configured to be biased within the C-shaped stud to engage one of the L-shaped flanges to provide a biasing force on the cover to secure the cover to the C-shaped stud. The spring means may comprise a generally S-shaped leg. The first and second U-shaped clips may be integral with the plate, such that a portion of the plate proximal the first end defines one of the two generally parallel legs of the first U-shaped clip and a separate portion of the plate proximal the second end defines one of the two generally parallel legs of the second U-shaped clip.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
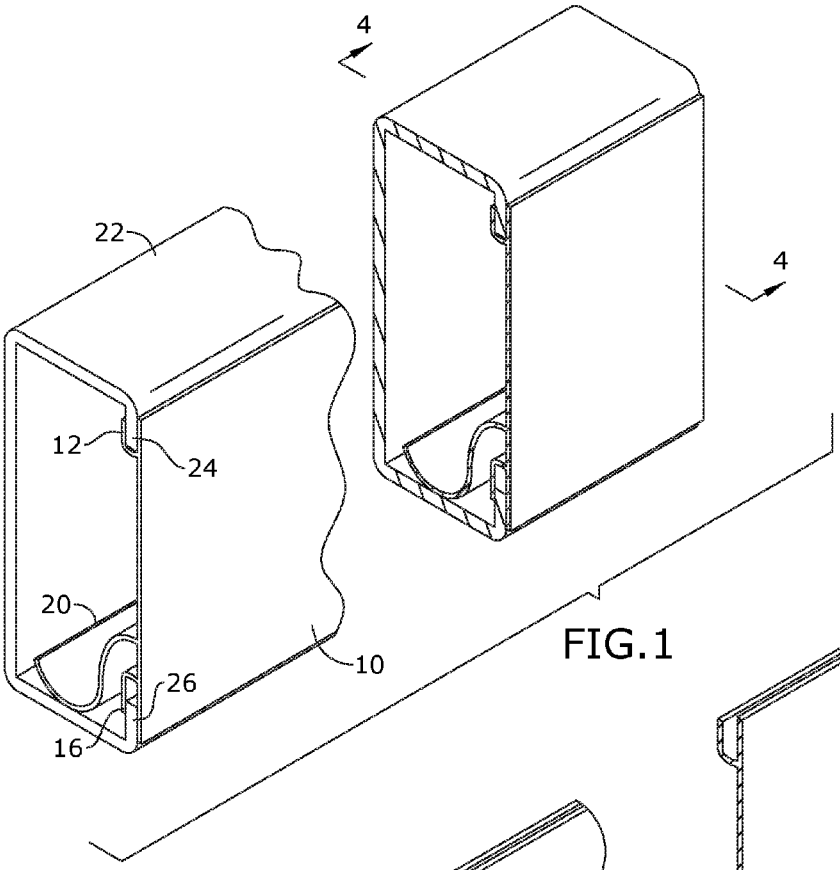
FIG. 1 shows a perspective view of the invention, shown in use.

By way of example, and referring to FIGS. 1 through 4, one embodiment of the present system comprises a cover 10 for a C-shaped stud 22 having a first L-shaped flange with first and second legs 24 and a second L-shaped flange with first and second legs 26, and web between the first and second L-shaped flanges, the space between the second leg of the first L-shaped flange and the second leg of the second L-shaped flange having a first dimension. The cover 10 comprises a semi-rigid plate having a first face comprising a first end and a second end, the distance between the first and second end comprising a second dimension greater than the first dimension. The cover can be fabricated from steel, plastic or other semi-rigid material which is known to persons of ordinary skill in the art. A first U-shaped clip 12 having generally parallel legs is positioned proximal the first end of the plate 10 and configured to engage the second leg of the first L-shaped flange 24 of the stud 22 such that the second leg of the first L-shaped flange is secured between the generally parallel legs of the first U-shaped clip within groove 14. A second U-shaped clip 16 having generally parallel legs positioned proximal the second end of the plate 10 and configured to engage the second leg of the second L-shaped flange 26 of the stud 22 such that the second leg of the second L-shaped flange is secured between the generally parallel legs of the second U-shaped clip in groove 18. The cover can be applied to the C-shaped stud by bending the plate sufficiently to permit the second legs of each of the first and second L-shaped flanges to fit within the generally parallel legs of the first and second U-shaped clips.

The first and second U-shaped clips 12, 16 may be integral with the plate such that a portion of the plate proximal the first end defines one of the two generally parallel legs of the first U-shaped clip forming groove 14, and a separate portion of the plate proximal the second end defines one of the two generally parallel legs of the second U-shaped clip forming groove 18.

Figure 2:
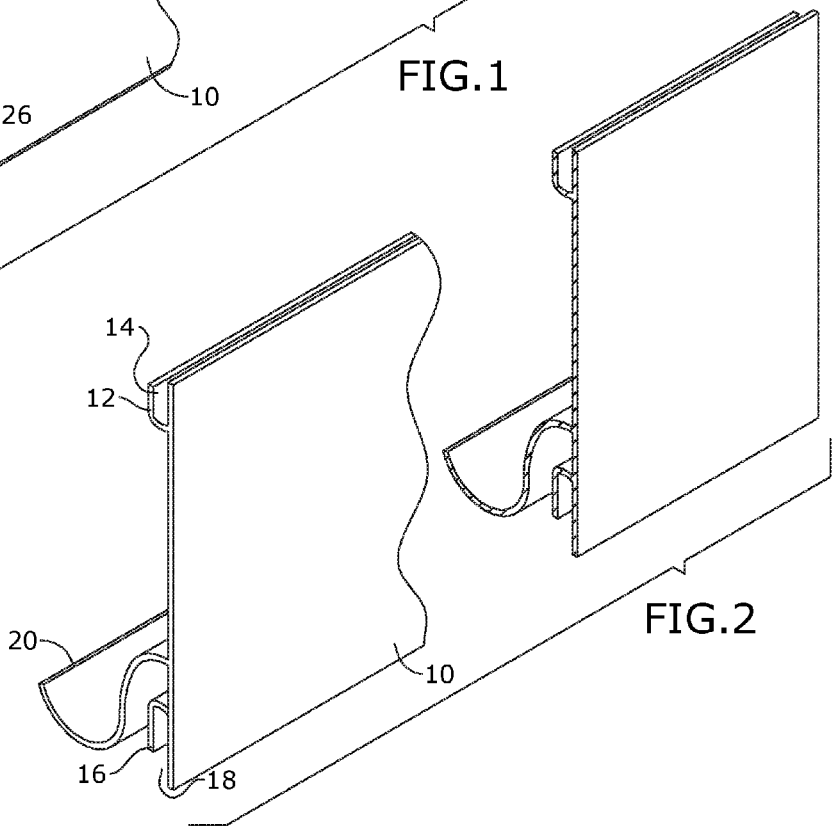
FIG. 2 shows a perspective view of the invention.
Figure 3:
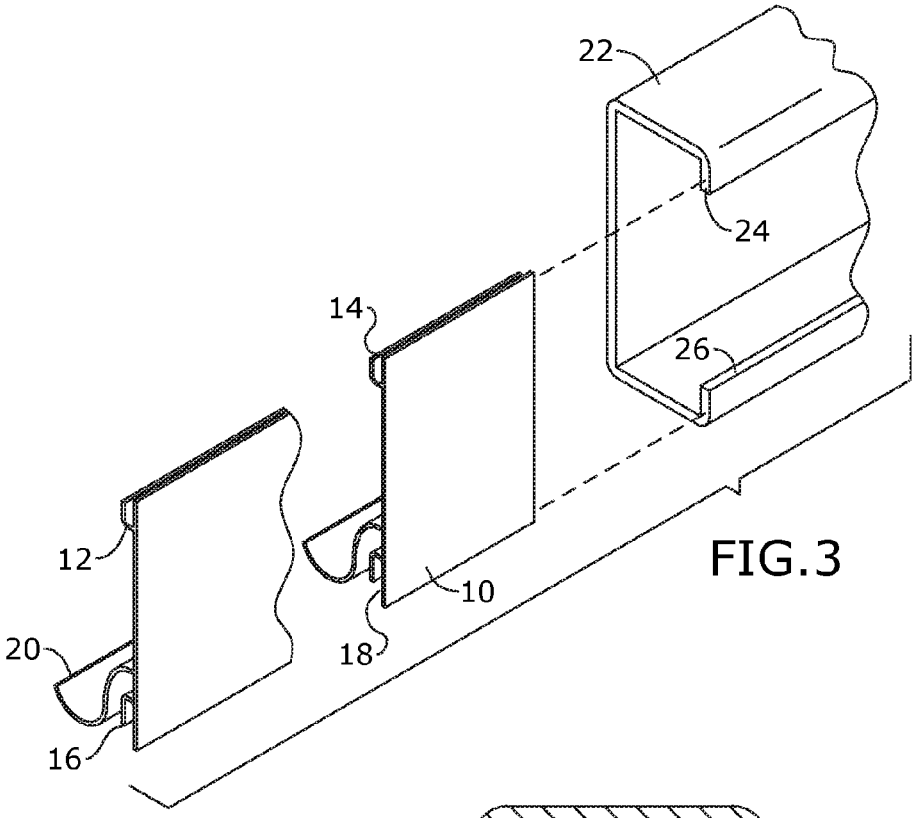
FIG. 3 shows a perspective view of the invention, illustrating placement of the cover onto a c-shaped stud.
Figure 4:
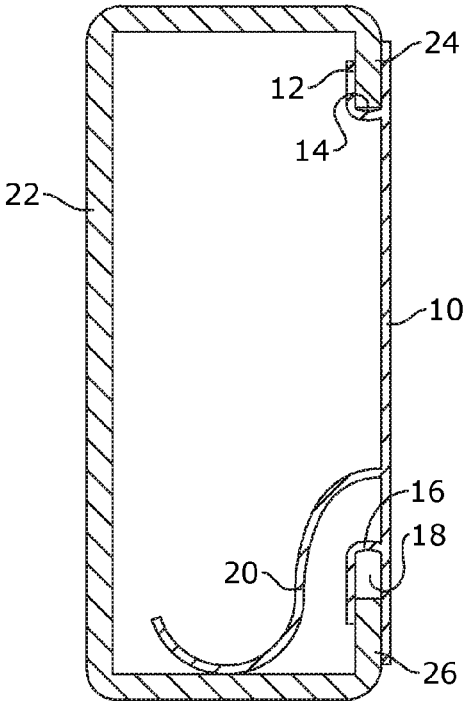
FIG. 4 is a section view of the invention, taken along line 4-4 in FIG. 1.

In an alternate embodiment, the cover for a C-shaped stud further incorporates a spring means 20 positioned between the first and second U-shaped clips on the plate. The spring means 20 configured to be biased so as to be positioned within the C-shaped stud to engage one of the L-shaped flanges to provide a biasing force on the cover to secure the cover to the C-shaped stud. The spring means comprises a generally S-shaped leg 20 as depicted in FIG. 2. The generally S-shaped leg may be unitary with the plate as depicted in FIG. 4.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cover for a C-shaped stud having a first L-shaped flange with first and second legs and a second L-shaped flange with first and second legs, and web between the first and second L-shaped flanges, the space between the second leg of the first L-shaped flange and the second leg of the second L-shaped flange having a first dimension, the cover comprising:

a semi-rigid plate having a first face comprising a first end and a second end, the distance between the first and second end comprising a second dimension greater than the first dimension;

a first U-shaped clip having generally parallel legs, the first U-shaped clip positioned proximal the first end of the plate and configured to engage the second leg of the first L-shaped flange of the stud such that the second leg of the first L-shaped flange is secured between the generally parallel legs of the first U-shaped clip; and a second U-shaped clip having generally parallel legs, the second U-shaped clip positioned proximal the second end of the plate and configured to engage the second leg of the second L-shaped flange of the stud such that the second leg of the second L-shaped flange is secured between the generally parallel legs of the second U-shaped clip;

whereby the cover can be applied to the C-shaped stud by bending the plate sufficiently to permit the second legs of each of the first and second L-shaped flanges to fit within the generally parallel legs of the first and second U-shaped clips; and a spring means positioned between the first and second U-shaped clips on the plate, the spring means configured to be biased so as to be positioned within the C-shaped stud to engage one of the L-shaped flanges to provide a biasing force on the cover to secure the cover to the C-shaped stud.

2. The cover for a C-shaped stud of claim 1 whereby the first and second U-shaped clips are integral with the plate, such that a portion of the plate proximal the first end defines one of the two generally parallel legs of the first U-shaped clip and a separate portion of the plate proximal the second end defines one of the two generally parallel legs of the second U-shaped clip.

3. The cover for a C-shaped stud of claim 1, wherein the spring means comprises a generally S-shaped leg.

4. The cover for a C-shaped stud of claim 3, wherein the generally S-shaped leg is unitary with the plate.

* * * * *